US007515013B2

(12) United States Patent
O'Connell et al.

(10) Patent No.: US 7,515,013 B2
(45) Date of Patent: Apr. 7, 2009

(54) RECTANGULAR WAVEGUIDE CAVITY LAUNCH

(75) Inventors: John B. O'Connell, Seattle, WA (US); Stephen L. Fahley, Renton, WA (US)

(73) Assignee: The Boeing Company, Chicago, IL (US)

( * ) Notice: Subject to any disclaimer, the term of this patent is extended or adjusted under 35 U.S.C. 154(b) by 160 days.

(21) Appl. No.: 11/608,235

(22) Filed: Dec. 7, 2006

(65) Prior Publication Data

US 2008/0136549 A1 Jun. 12, 2008

(51) Int. Cl.
*H01P 1/16* (2006.01)
*H01P 7/06* (2006.01)

(52) U.S. Cl. ..... 333/21 R; 333/26; 333/230; 333/248

(58) Field of Classification Search ..... 333/21 R, 333/26, 230, 248
See application file for complete search history.

(56) References Cited

U.S. PATENT DOCUMENTS 2,659,055 A * 11/1953 Cohn ..... 333/35
7,064,633 B2 * 6/2006 Wu et al. ..... 333/230

* cited by examiner

*Primary Examiner*—Benny Lee
(74) *Attorney, Agent, or Firm*—Canady & Lortz LLP; Bradley K. Lortz

(57) ABSTRACT

An apparatus and method relating to a rectangular waveguide cavity launch are disclosed that enable coupling an electromagnetic wave from the top surface of a waveguide distribution network formed into a conductive plate with the narrow wall of a rectangular waveguide facing the top of the conductive plate. A resonant cavity structure is formed into a conductive plate and coupled to a waveguide also formed into the plate, the resonant cavity structure having a cavity width wider than the narrow wall dimension of the waveguide. The resonant cavity structure includes a conductive block within it having a block width substantially equal to a difference between the cavity width of the resonant cavity structure and the narrow wall dimension. The cavity launch excites and rotates a dominant waveguide mode entering the structure such that the dominant waveguide mode enters the waveguide substantially parallel to the narrow wall dimension.

21 Claims, 12 Drawing Sheets

RECTANGULAR WAVEGUIDE CAVITY LAUNCH

GOVERMENT RIGHTS STATEMENT

This invention was made with Government support under contract number N00014-02-C-0068 awarded by the United States Navy. The Government has certain rights in this invention.

BACKGROUND OF THE INVENTION

1. Field of the Invention

This invention relates to waveguides. Particularly, this invention relates to radio frequency (RF) radiation transmission in rectangular waveguides such as may be employed in phased array antennas.

2. Description of the Related Art

A well understood transmission media of RF electromagnetic energy is the rectangular waveguide. The rectangular waveguide supports an infinite number of electromagnetic field patterns, or modes, in which the dominant field mode (TE10) is the most commonly used. The physical realization of the TE10 mode is a consequence of the geometry of the rectangular waveguide. The mode title, TE10, is a description of the field pattern; TE indicates that the E field component of the field pattern is always transverse (T) to the XY plane while the H field component may be either transverse or normal to the XY plane.

FIGS. 1A and 1B illustrate a TE10 wave excited in a rectangular waveguide using either an E field probe or an H field probe, respectively. As shown in FIG. 1A, an E field probe 102 is inserted into the waveguide 100 through the broad wall 104 of the waveguide 100 tangential (or parallel) to the E Field and is easily realizable with a coaxial cable where the coaxial shield 106 is grounded to the broad wall 104 of the waveguide 100 while the center probe 108 continues into the waveguide a determined distance. As shown in FIG. 1B, an H field probe 122 is inserted into the waveguide 120 through the narrow wall 124 and may be realized by looping the exposed center conductor 126 of a coaxial cable a determined length and attaching its end to the waveguide's broad wall 128 while the coaxial shield 130 is grounded to the narrow wall 124 of the waveguide 120. The loop of the H field probe 122 must be oriented such that the H field 132 is generated normal to the plane of the loop. Typically, an E field probe 102 will have a wider bandwidth than an H field probe 122. While an E field probe 102 is easier to manufacture and is the preferred method of exciting and launching a waveguide mode, an E field probe inserted into the narrow wall of a rectangular waveguide will not excite the dominant field pattern because it is orthogonal to the E field of the dominant mode. In both FIGS. 1A and 1B, the direction of propagation is along the z axis as shown.

Distribution networks that distribute power between a single input and multiple outputs are commonly developed using rectangular waveguides machined into conductive plate. In such a conventional waveguide distribution network, it is often preferred that the broad wall of the rectangular waveguide face the top of the plate. For example, referring to FIG. 1A, a plate of metal in the X-Z plane having a defined thickness in the Y dimension would have channels machined into it's surface defining a particular waveguide distribution network architecture. The channels are then covered with a top (e.g., a metallic plate) and, if required, a bottom plate ensuring continuous conductive waveguide surfaces. This allows the dominant transmission mode to be excited with an E field probe inserted from the top of the plate as shown in FIG. 1A and allows the most convenient machining of the splitters, bends and hybrids that are commonly used components of the waveguide architecture. Probes may be installed from the top or bottom surfaces of the network structure.

When used in a phased array antenna, the required distance between waveguide transmission paths decreases as the operating frequency and scan angle increases. This is a consequence of the reduction in spacing between array modules at the antenna face that are fed by the waveguide distribution network. The broad wall of rectangular waveguide measures twice in length or greater than the narrow wall. Thus, phased array antennas operating in microwave frequencies with high scan angles typically require a much denser waveguide distribution network pattern.

In view of the foregoing, there is a need in the art for apparatuses and methods for providing waveguide cavity launches that are easily implemented with plate-fabricated waveguide distribution networks. Further, there is a need for such apparatuses and methods to support dense waveguide distribution network patterns such as those employed in phased array antenna for communication satellites. Particularly, there is a need for such systems and methods to allow an easily manufactured E field probes to be used entering the narrow wall plane of a waveguide structure. These and other needs are met by the present invention as detailed hereafter.

SUMMARY OF THE INVENTION

An apparatus and method relating to a rectangular waveguide cavity launch are disclosed that enable coupling an electromagnetic wave from the top surface of a waveguide distribution network formed into a conductive plate with the narrow wall of a rectangular waveguide facing the top of the conductive plate. A resonant cavity structure is formed into a conductive plate and coupled to a waveguide also formed into the plate, the resonant cavity structure having a cavity width wider than the narrow wall dimension of the waveguide. The resonant cavity structure includes a conductive block within it having a block width substantially equal to a difference between the cavity width of the resonant cavity structure and the narrow wall dimension. The cavity launch excites and rotates a dominant waveguide mode entering the structure such that the dominant waveguide mode enters the waveguide substantially parallel to the narrow wall dimension.

A typical embodiment of the invention comprises a waveguide cavity launch including a waveguide formed into a conductive plate, the waveguide having a narrow wall dimension parallel to a top surface of the conductive plate and a broad wall dimension parallel to a thickness of the plate. A resonant cavity structure is also formed into the conductive plate and coupled to the waveguide, the resonant cavity structure having a cavity width wider than the narrow wall dimension. The resonant cavity structure includes a conductive block within it having a block width substantially equal to a difference between the cavity width of the resonant cavity structure and the narrow wall dimension. The resonant cavity structure including the conductive block is capable of exciting and rotating a dominant waveguide mode entering the resonant cavity structure such that the dominant waveguide mode enters the waveguide substantially parallel to the narrow wall dimension.

In some embodiments of the invention, the broad wall dimension is substantially equal to a cavity height of the resonant cavity structure. However, in other embodiments, the broad wall dimension may not be equal to a cavity height of the resonant cavity structure. In the latter case the coupled waveguide may be tuned to the resonant cavity structure applying conventional techniques known to those skilled in the art.

Embodiments of the invention comprising the waveguide, the resonant cavity structure and the conductive block may be included in a power distribution network, such as for a satellite antenna system. In one notable example, the power distribution network may be included in a phased array antenna system.

In further embodiments, an E field probe may be inserted into the resonant cavity structure through a face of the resonant cavity structure opposite the conductive block. The E field probe is used for exciting the dominant waveguide mode entering the resonant cavity structure.

In still further embodiments, a conductive ridge may be disposed between the conductive block and a tip of the E field probe inserted into the resonant cavity structure opposite the conductive block. The conductive ridge may be designed having a geometry for impedance matching the E field probe to the waveguide. For example, the geometry of the conductive ridge may include a ridge width less than the block width and a ridge length less than a block length of the conductive block. Typically, the E field probe comprises a low impedance relative to a higher impedance of the waveguide.

Similarly, a typical method of producing a waveguide cavity launch comprises the steps of forming a waveguide into a conductive plate, the waveguide having a narrow wall dimension parallel to a top surface of the conductive plate and a broad wall dimension parallel to a thickness of the plate, forming a resonant cavity structure into the conductive plate, the resonant cavity structure coupled to the waveguide and having a cavity width wider than the narrow wall dimension, and forming a conductive block included within the resonant cavity structure, the conductive block having a block width substantially equal to a difference between the cavity width of the resonant cavity structure and the narrow wall dimension. As before, the resonant cavity structure including the conductive block is capable of exciting and rotating a dominant waveguide mode entering the resonant cavity structure such that the dominant waveguide mode enters the waveguide substantially parallel to the narrow wall dimension. Method embodiments of the invention may be further modified consistent with the apparatus and systems described herein.

BRIEF DESCRIPTION OF THE DRAWINGS

Referring now to the drawings in which like reference numbers represent corresponding parts throughout, but said parts may not be described in detail in every drawing in which they appear.

DETAILED DESCRIPTION OF THE PREFERRED EMBODIMENT

1. Overview

In a plate manufactured waveguide distribution network, if the waveguides are oriented with their narrow walls facing the top plate, it is possible to produce a distribution network for higher frequencies of operation than physically possible with designs having the broad walls of the waveguides facing the top of the plate. However, it is also desirable to avoid using H field probes which would require a loop structure in order to excite the proper dominant mode in such waveguides. The necessary loop structure would make manufacturing more expensive and difficult.

Accordingly, embodiments of the present invention enable the preferred dominant mode excitation technique, i.e. using an E field probe, to launch an electromagnetic wave from the top surface of a waveguide distribution network formed into a conductive plate with the narrow wall of a rectangular waveguide facing the top of the conductive plate. A resonant cavity structure is formed into a conductive plate and coupled to a waveguide also formed into the plate, the resonant cavity structure having a cavity width wider than the narrow wall dimension of the waveguide. The resonant cavity structure includes a conductive block within it having a block width substantially equal to a difference between the cavity width of the resonant cavity structure and the narrow wall dimension. Thus, the resonant cavity structure including the conductive block is capable of exciting and rotating a dominant waveguide mode entering the resonant cavity structure such that the dominant waveguide mode enters the waveguide substantially parallel to the narrow wall dimension.

2. Waveguide Transmission in Distribution Networks

Figure 2A:
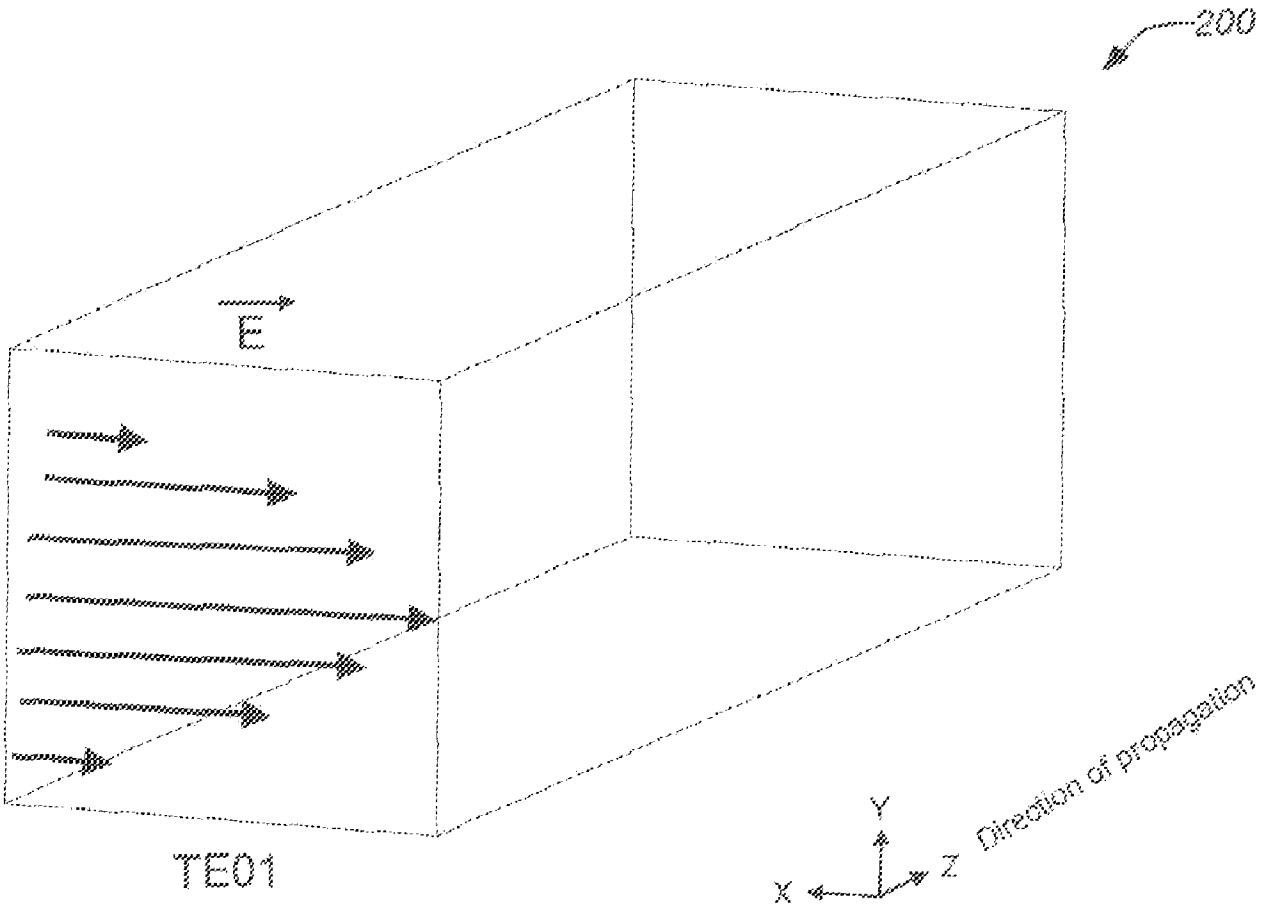
FIGS. 2A and 2B illustrates a square waveguide transmission line supporting the dominant transmission mode in two orientations, TE01 or TE10, respectively.
Figure 2B:
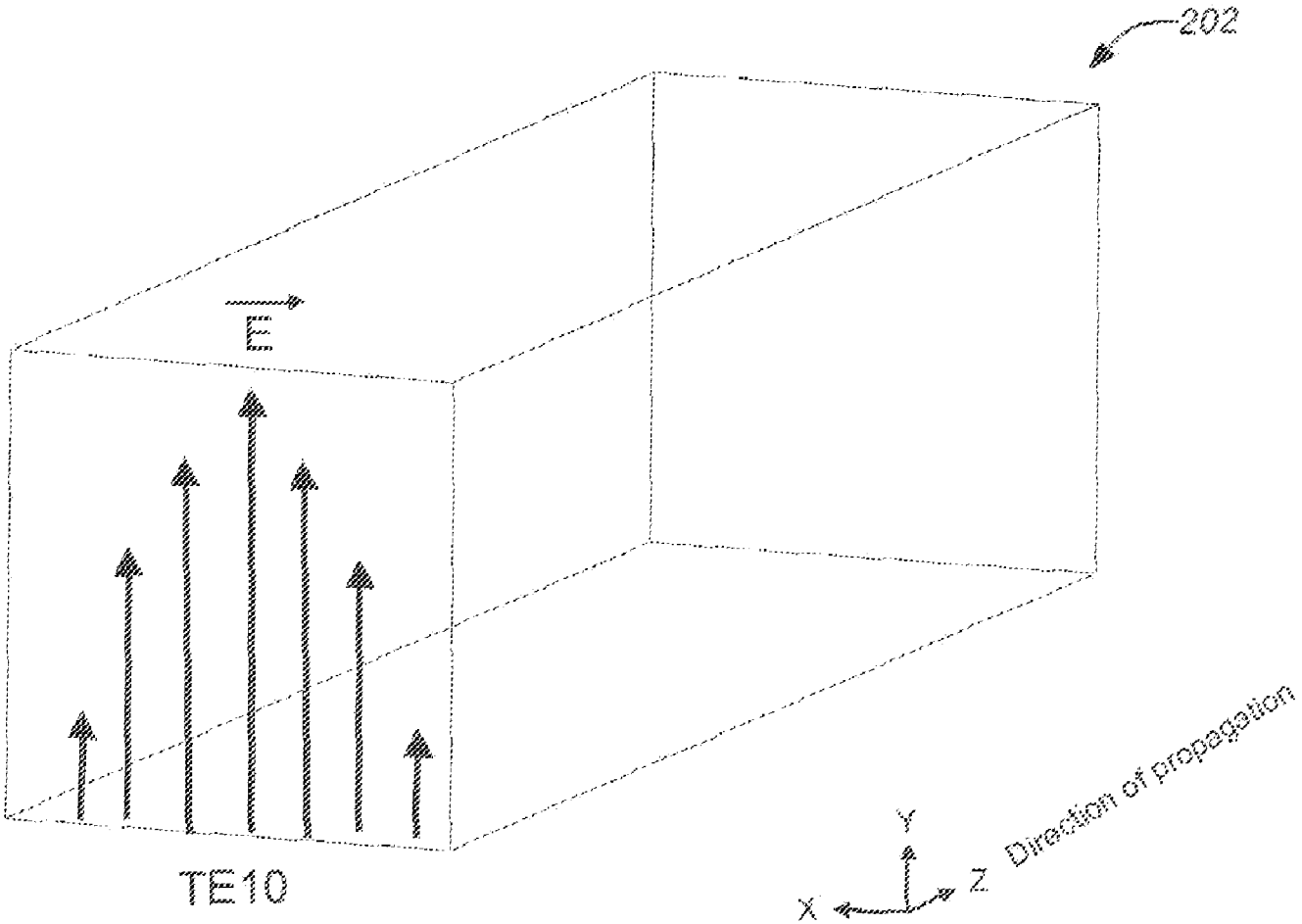

FIGS. 2A and 2B illustrate a square waveguide transmission line supporting the dominant transmission mode in two orientations, TE01 or TE10, respectively. The square cross section boxes 200, 202 represent waveguide portions supporting the dominant transmission mode E fields in the two orientations as shown. It should be noted that throughout the present description waveguide portions are illustrated as they would be formed channels into a conductive plate coupled to a larger waveguide network lying flat in the X-Z planes shown as will be understood by those skilled in the art. Further the wave propagation occurs in the positive Z direction. The illustrated resonant details, such as the specific dimensions of the waveguides, wall thickness, etc. and material selection will depend upon the particular application and may be readily developed by those skilled in the art using conventional analysis and design techniques. Further, the term "conductive plate" as used herein and employed in the development of embodiments of the invention may be a metal plate, conductive non-metal or composite plate or any conductive planar material which is known and used in the construction of waveguide distribution networks in which channels are formed into a material surface. The cavity and/or waveguides with the conductive plates may be formed into the conductive plates through machining, casting or any other suitable process for creating the structures described herein.

Figure 3:
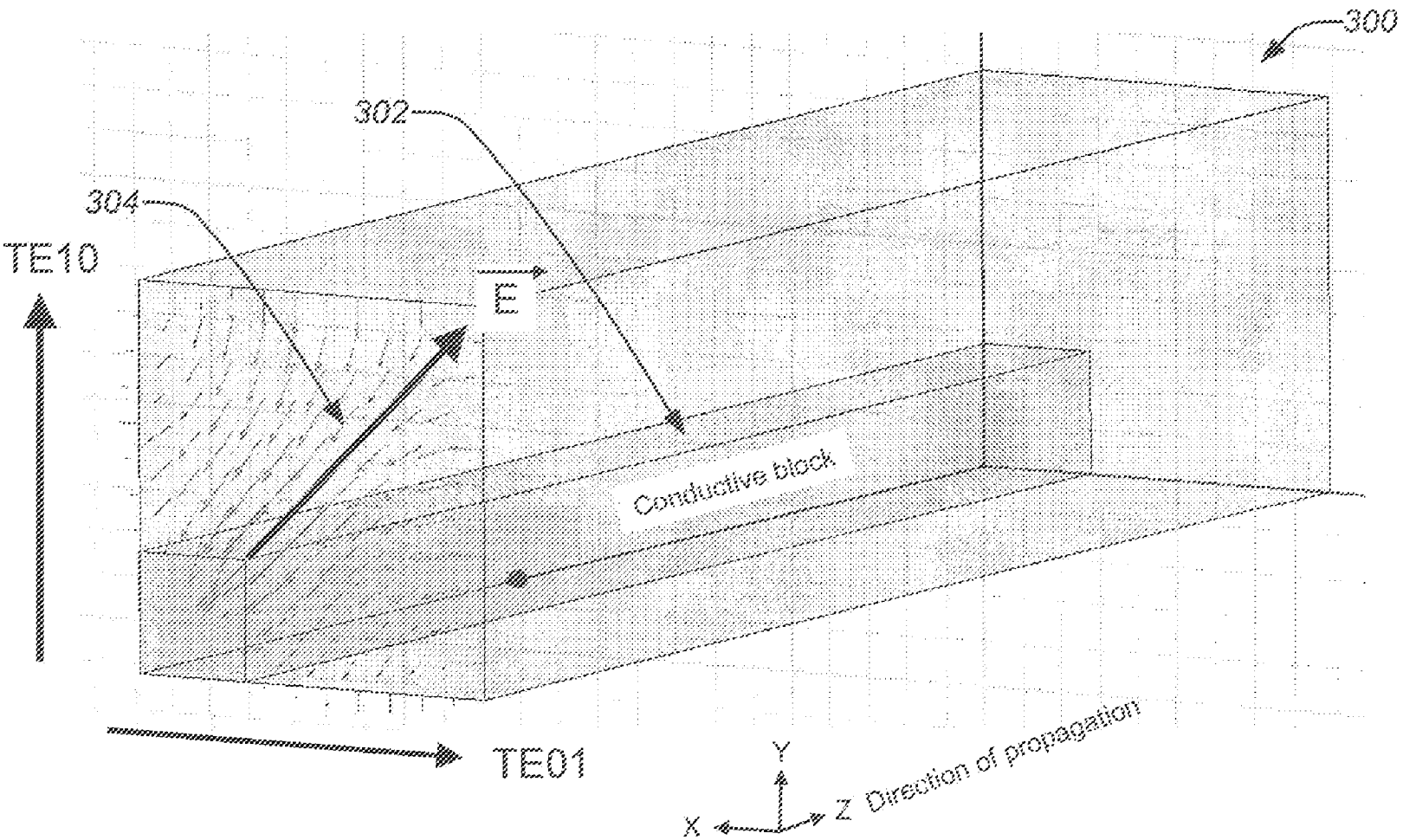
FIG. 3 illustrates forced orientation of a transmission field vector.

FIG. 3 illustrates forced orientation of a transmission field vector. It is known that the orientation of either dominant mode within a square waveguide 300 may be rotated forty five degrees by placing a block 302 of conductive material in one of the corners of the square waveguide 300. This conductive block 302 forces the transmission field 304 to be shared equally by both dominant transmission modes. It is also known that a resonant cavity structure may be constructed from a box formed by conductive square walls with dimensions equal to approximately one half wavelength. Embodiments of the present invention apply these principles in the construction of a novel waveguide cavity launch structure having the desirable properties previously mentioned.

3. Rectangular Waveguide Cavity Launch

Figure 4:
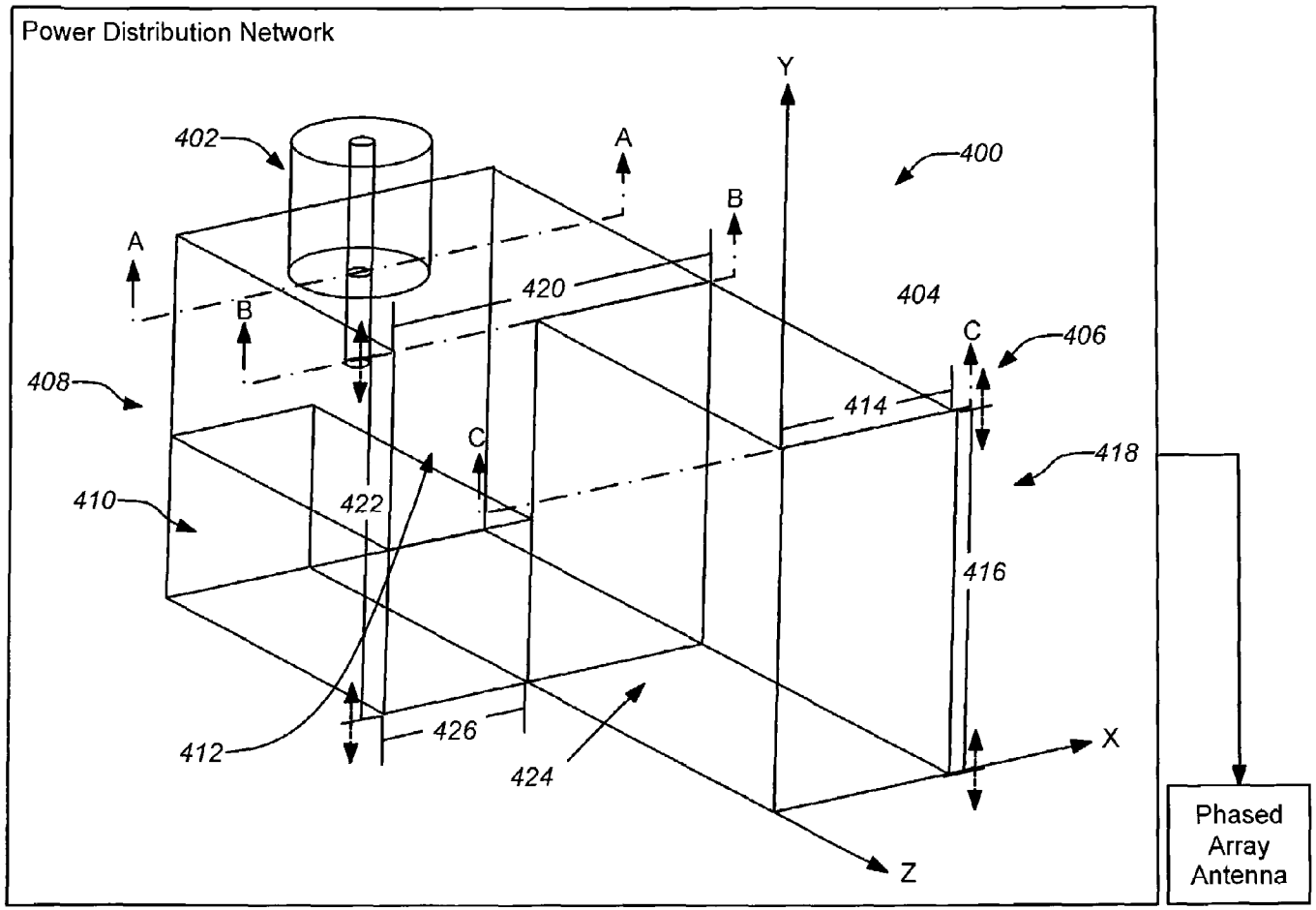
FIG. 4 illustrates an exemplary embodiment of a rectangular waveguide cavity launch.

FIG. 4 illustrates an exemplary embodiment of a rectangular waveguide cavity launch 400. Embodiments of the invention can excite and rotate a dominant waveguide mode approximately ninety degrees using an E field probe 402 oriented normal to the narrow wall 404 of a rectangular waveguide 406. The waveguide cavity launch 400 can be constructed by machining features of a resonant cavity structure 408 and coupled waveguide 406 into a conductive plate 418 (e.g. a metal plate) such that the length and height of a square waveguide transmission line are reduced to approximately one half of the operating wavelength to form the overall height 422 and width 420 of the resonant cavity structure 408. The operating wavelength is the wavelength of the RF transmitted through the waveguide. A block 410 of conductive material is then disposed in a single corner of the resonant cavity structure 408, e.g. formed as part of the structure 408 or added as a separate element. An E field probe 402 may be inserted into the resonant cavity structure 408 through the face opposite the conductive block 410. A rectangular waveguide 406 is then positioned having a narrow wall 404 is aligned normal with a plane of the E field probe 402 and a broad wall 424 that is perpendicular to the narrow wall 404.

Figure 1A:
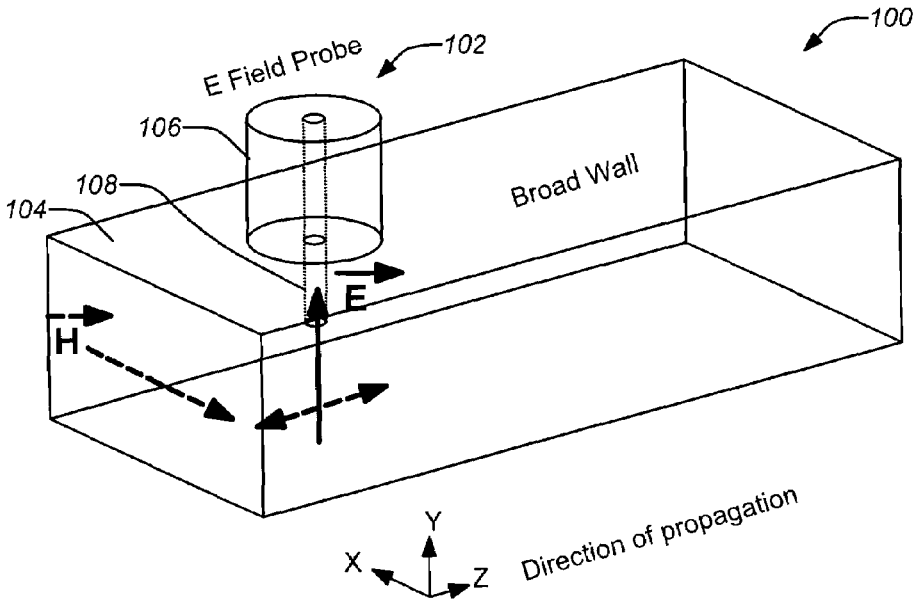
Related Art FIG. 1A
FIGS. 1A and 1B illustrate a TE10 wave excited in a related art rectangular waveguide using either an E field probe or an H field loop, respectively.
Figure 1B:
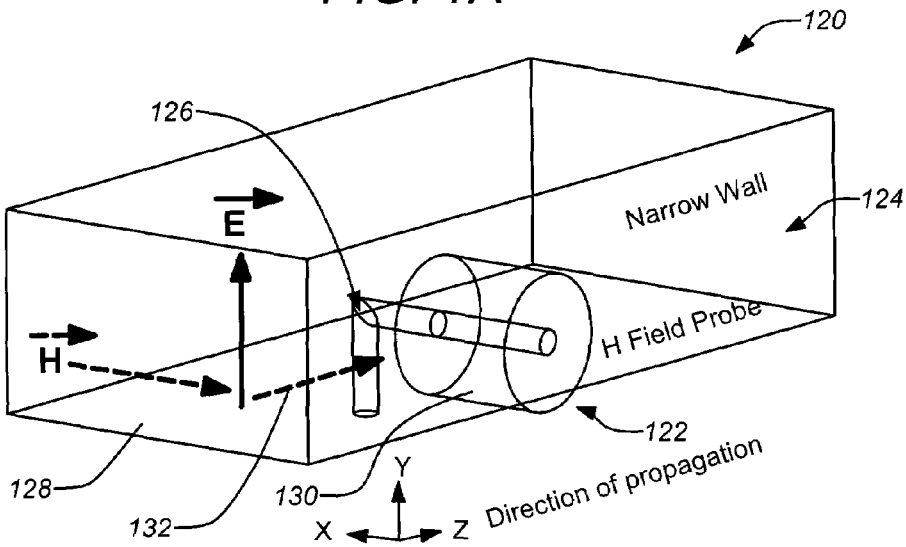
Related Art FIG. 1B

The narrow wall dimension 414 (i.e. width) of the waveguide 406 is parallel to a top surface of the conductive plate 418 and the broad wall dimension 416 (i.e. height) is parallel to a thickness of the conductive plate 418. Note: as previously described with respect to FIG. 2A, the conductive plate 418 is generally material surrounding the hollow areas of the resonant cavity structure 408 and the waveguide 406 having a thickness in the Y direction and a planar shape in the X-Z plane as shown in FIG. 4. The resonant cavity structure 408 formed into the conductive plate 418 and coupled to the waveguide 406 has a cavity width 420 parallel to and wider than the narrow wall dimension 414. For example, the cavity width 420 may be approximately one half the narrow wall dimension 414. In one example, the E field probe 402 itself may be of a conventional design as previously described in FIG. 1A. For example, the E field probe 402 may be inserted into the resonant cavity structure 408 through a face of the resonant cavity structure opposite the conductive block 410. The E field probe 402 initially excites a TE10 mode. The conductive block 410 within the resonant cavity structure 408 has a block width 426 substantially equal to a difference between the cavity width 420 of the resonant cavity structure 408 and the narrow wall dimension 414.

In operation, the resonant cavity structure 408 including the conductive block 410 excites and rotates a dominant waveguide mode entering the resonant cavity structure 408 such that the dominant waveguide mode enters the waveguide 406 substantially parallel to the narrow wall dimension 414.

Figure 5A:
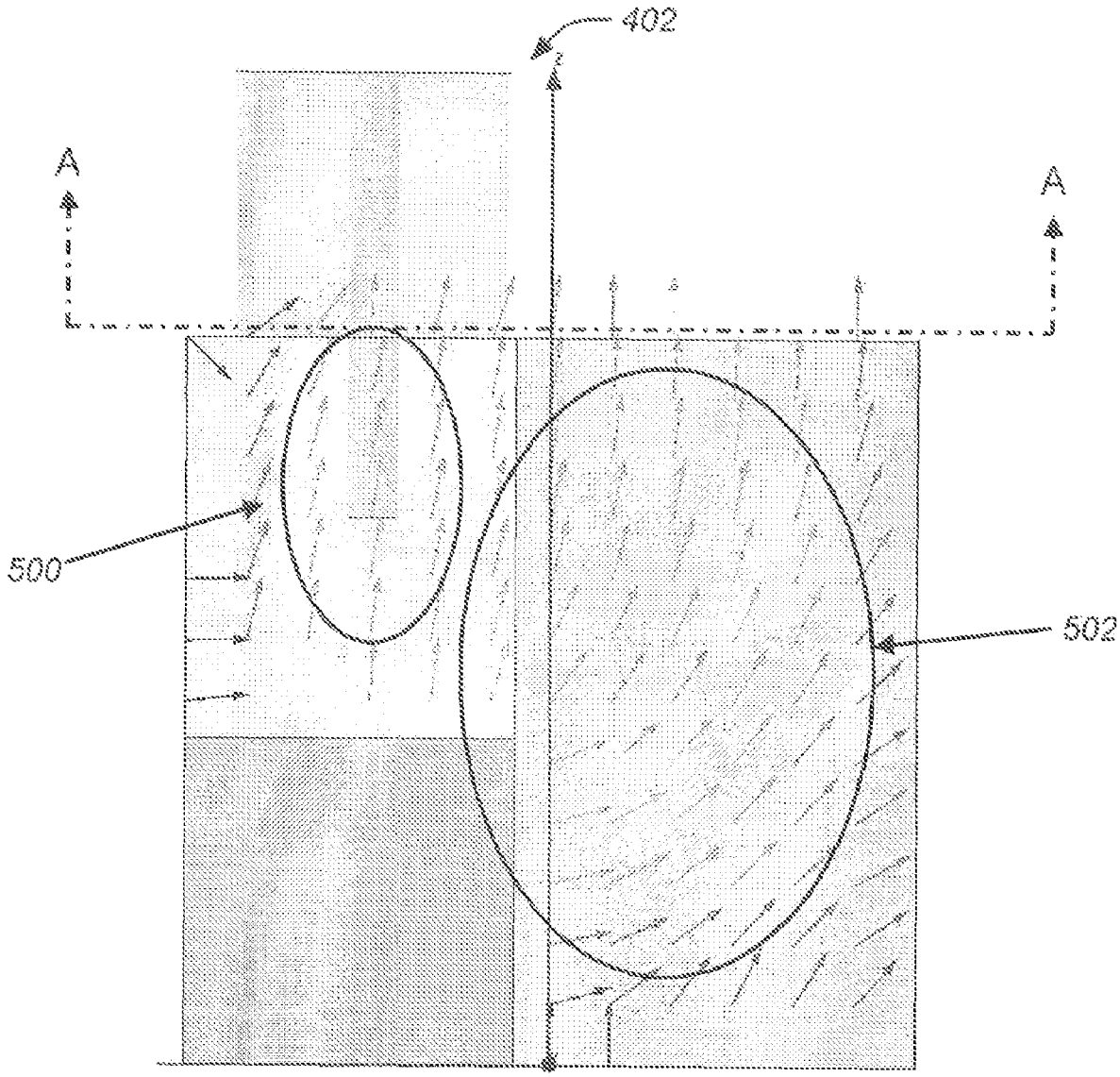
FIGS. 5A and 5B illustrates the E fields in the plane of the probe and entering the waveguide, respectively, for the rectangular waveguide cavity launch of FIG. 4.
Figure 5B:
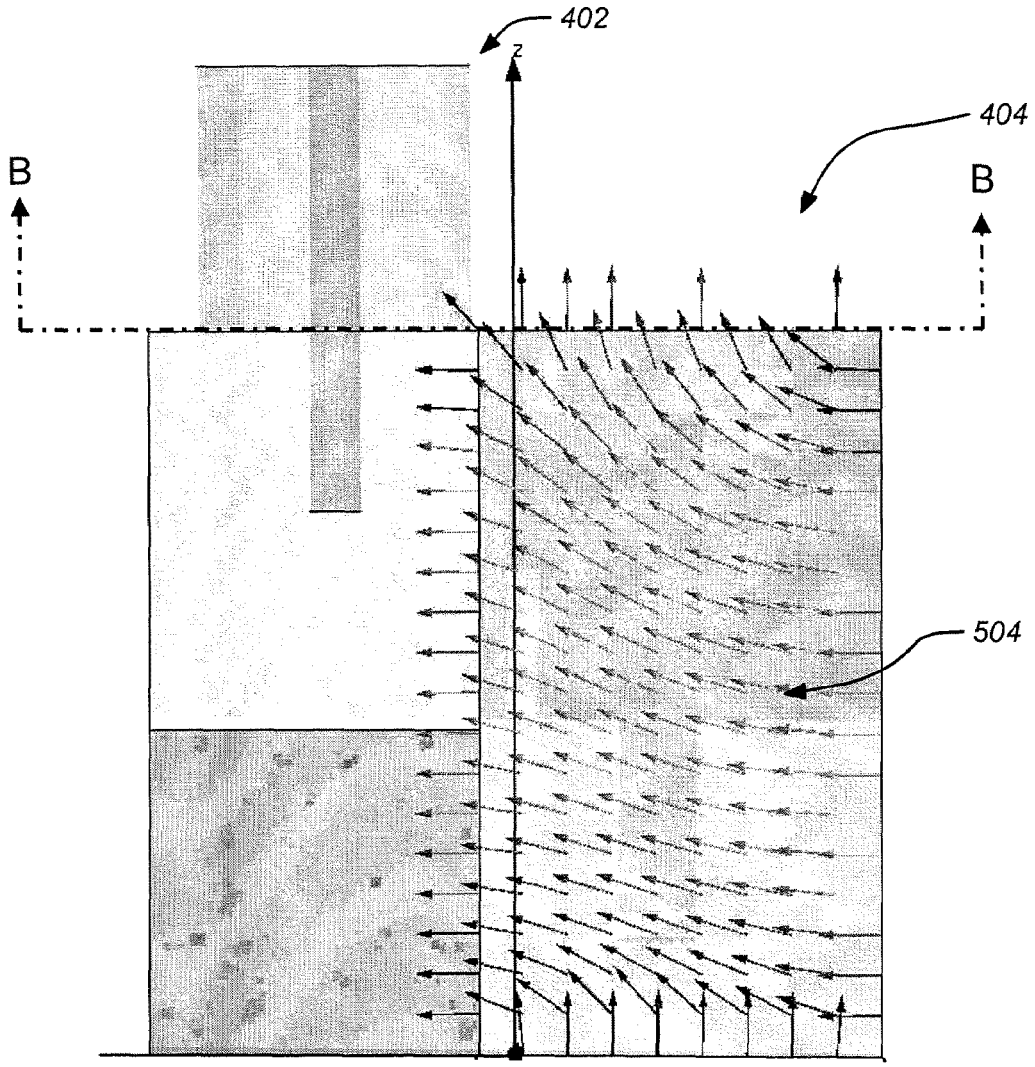

FIGS. 5A and 5B illustrates the E fields in the plane of the E field probe 402 and entering the waveguide 404, respectively, for the rectangular waveguide cavity launch 400 of FIG. 4. FIG. 5A illustrates the E field through section A-A of FIG. 4. The initial TE10 field in the first region 500 from the E field probe 402 rotates in the resonant cavity structure 408 approximately forty-five degrees in the section region 502 due to the conductive block 410 in FIG.4 where the energy is now substantially equally distributed between the TE10 and TE01 field modes.

FIG. 5B illustrates the E field through section B-B of FIG. 4 at the interface of the resonant cavity structure 408 with the waveguide. At the interface of the resonant cavity structure 408 with the waveguide 404. the magnitude of the TE10 field mode is reduced to zero due to electromagnetic boundary conditions at the conductive surface 412 (refer to FIG. 4). The remaining field vector, the TE01 mode 504, is transmitted into the rectangular waveguide 404 as shown in FIG. 5B.

Figure 5C:
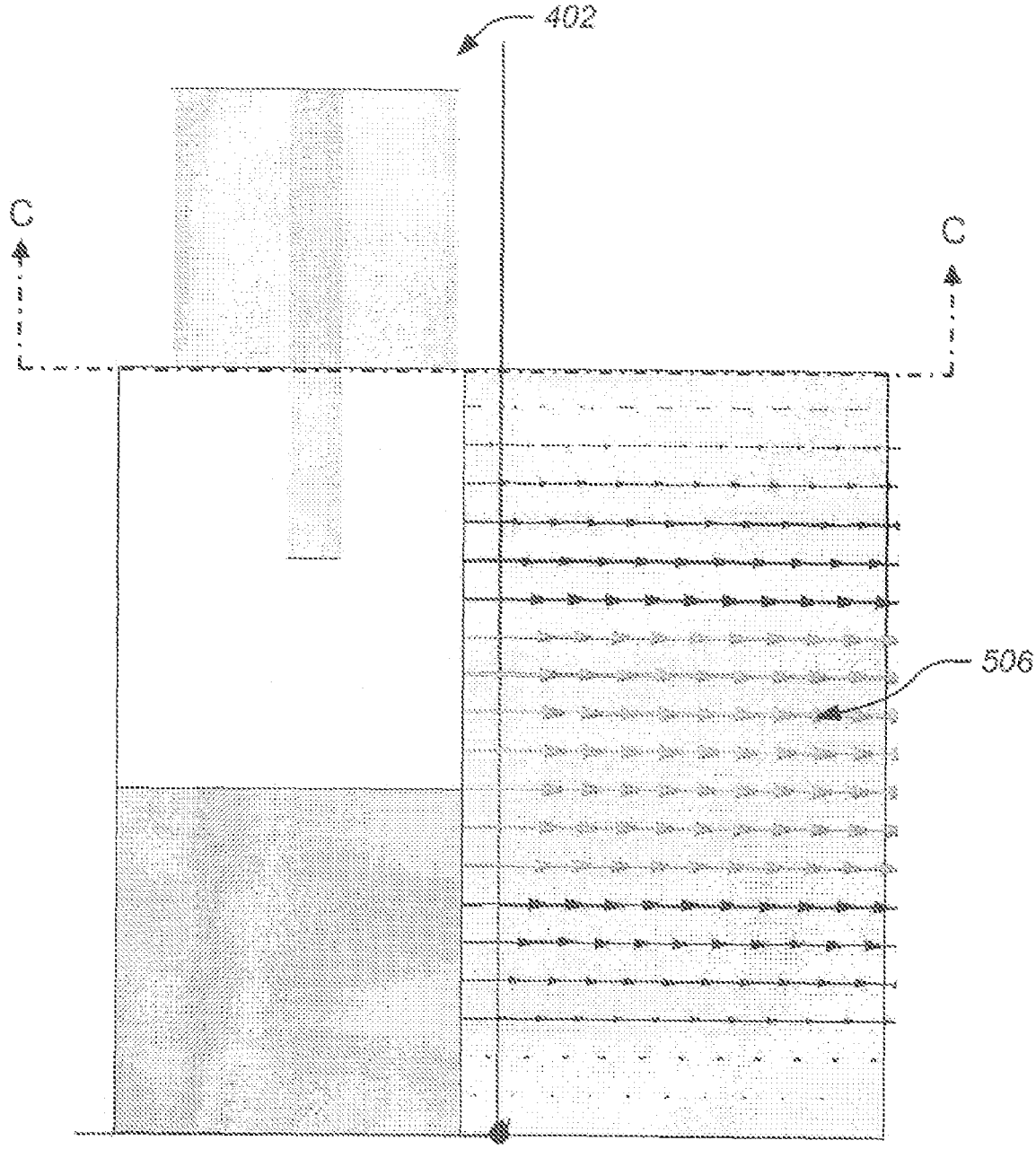
FIG. 5C illustrates the TE10 mode in the waveguide resulting from the rectangular waveguide cavity launch of FIG. 4.

FIG. 5C illustrates the TE10 rectangular waveguide dominant mode 506 in the waveguide 404 at section C-C resulting from the rectangular waveguide cavity launch 400 of FIG. 4. If the broad wall height 416 of the rectangular waveguide 404 is the same as the height 422 (Y axis) of the resonant cavity structure, no tuning is required at that interface (B-B Section) as shown in FIG. 4. However, even if the broad wall height 416 is not equal to the height 422 of the resonant cavity structure 408, (indicated as variable by the arrowed lines at each dimension end of the broad wall height 416 and the waveguide height 422 in FIG. 4), the discontinuity may be matched using standard waveguide matching techniques. For example, an inductive iris formed into the waveguide walls 406 or a capacitive (or inductive) iris thin plate dropped into the waveguide 406 may be used. Either feature would be set back (in the +Z direction) from the cavity/waveguide interface a determined distance. Thus, the broad wall dimension 416 may be substantially equal to a cavity height 422 of the resonant cavity structure in some cases or unequal in others.

The proper location and geometry of the E field probe 402 may be determined using common impedance matching techniques. Excitation of the resonant cavity structure 408 does not need to be by E field probe 402, although this may be considered the most likely application (due to manufacturing ease and other factors). For example, a waveguide could be inserted on the YZ wall of the cavity above the conductive block.

Figure 6:
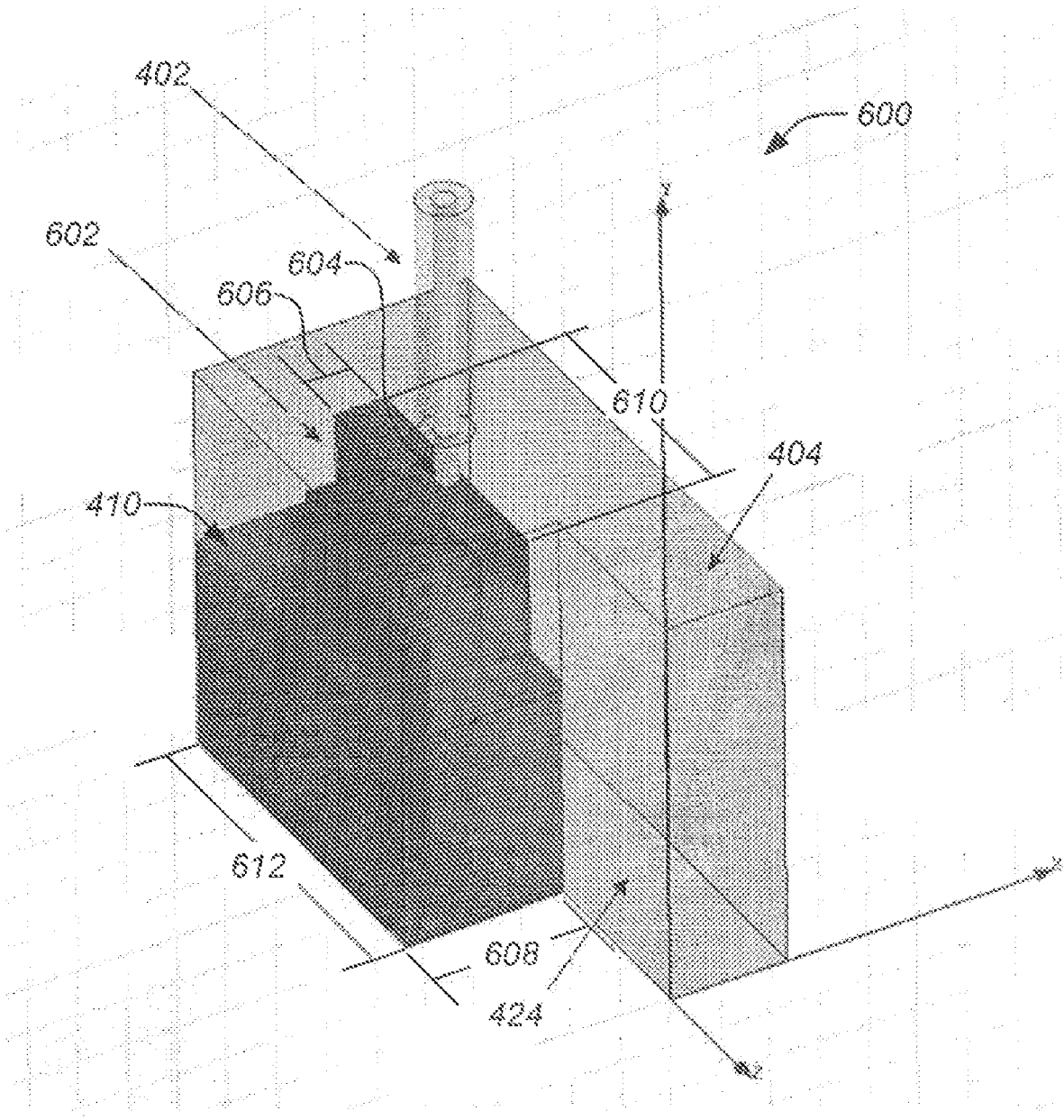
FIG. 6 illustrates another exemplary embodiment of a rectangular waveguide cavity launch.

FIG. 6 illustrates another exemplary embodiment of a rectangular waveguide cavity launch 600. Generally, this embodiment operates in the same manner as that of FIG. 4 and FIGS. 5A-5C, however with improved performance. This embodiment improves the circuit response over the previous structure cavity launch 500 by inserting a conductive ridge 602 between the tip 604 of the E field probe 402 and the top surface of the conductive block 410. The E field probe 402 is shorted to the top of the conductive ridge 602. Circuit impedance matching is controlled by the geometry of the conductive ridge 602. The conductive ridge 602 geometry matches the low impedance (typically 50 ohms) E field probe 402 to the higher impedance (e.g. several hundred ohms) of the waveguide 406. This yields a wider circuit bandwidth. Thus, the E field probe 402 may comprise a low impedance matched to a high impedance of the waveguide 406. The geometry of the conductive ridge 602 may include a ridge width 606 less than the block width 608 and a ridge length 610 less than a block length 612 of the conductive block 410.

Figure 7A:
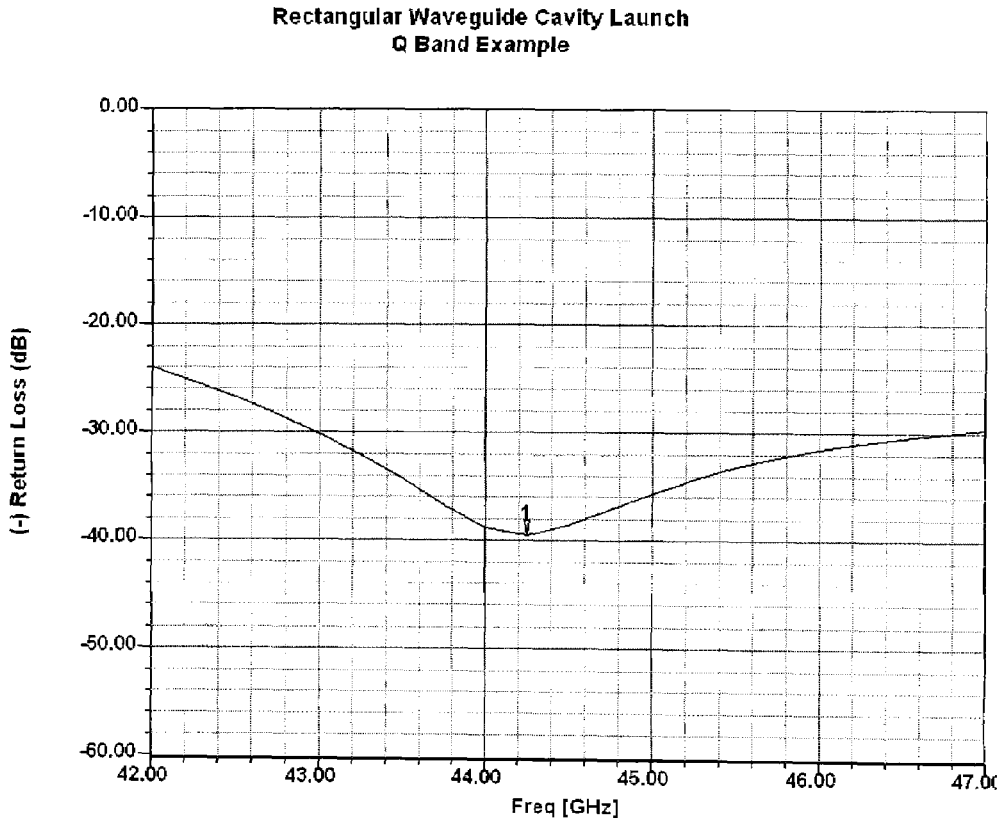
FIGS. 7A and 7B are return loss and insertion loss simulation results, respectively, for an exemplary embodiment of the invention.
Figure 7B:
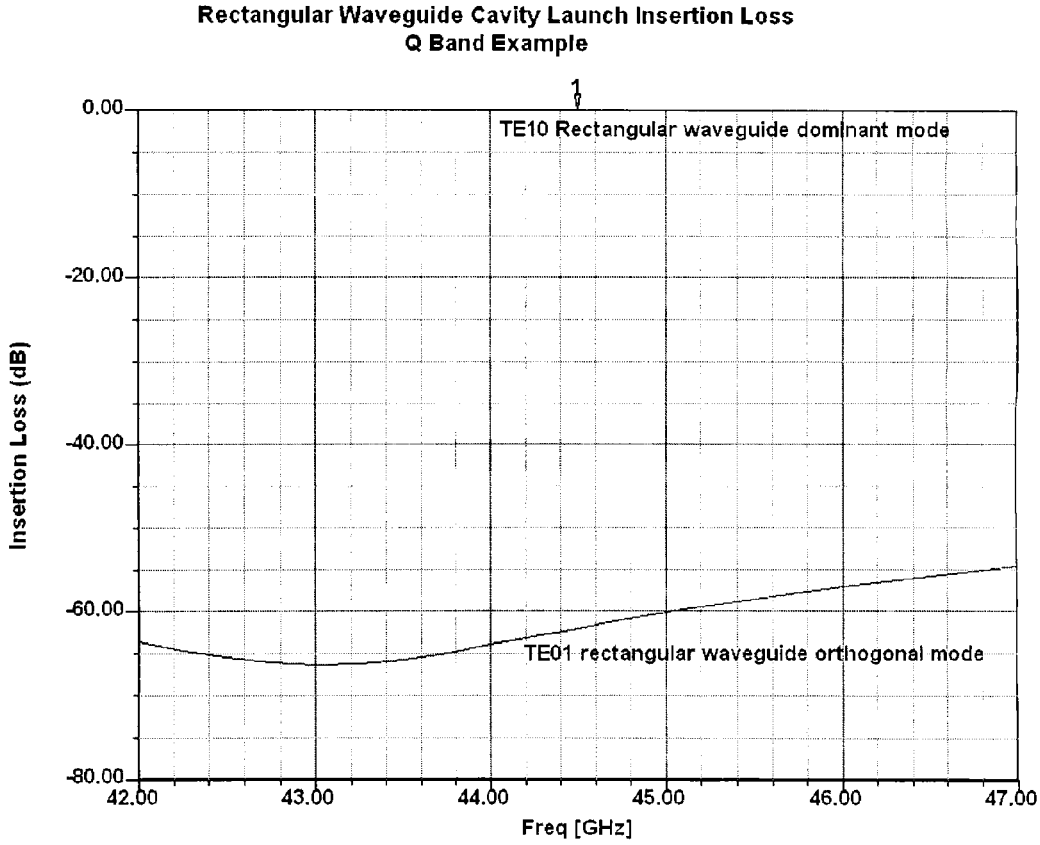

FIGS. 7A and 7B are return loss and insertion loss simulation results, (in dB) vs. frequency (in GHz), respectively, for an exemplary embodiment of the invention. Embodiments of the invention may be designed and simulated with electromagnetic simulation software such as Ansoft's HFSS, a commercial full wave electromagnetic simulation software package as will be understood by those skilled in the art. The baseline design has an approximately 3% bandwidth (defined as the difference between the upper frequency and the lower frequency divided by the center frequency) where the return loss greater than approximately 20 dB. The conductive ridge 602 version increases that bandwidth to greater than 11% as shown in FIG. 7A. The baseline design matches a 50 ohm coax to a waveguide impedance of greater than approximately 350 ohms. The conductive ridge acts as a transformer between those two impedances.

The waveguide cavity launch designs described herein including the waveguide, the resonant cavity structure and the conductive block may be employed in applications such as a power distribution network used in satellite communications. Because the construction provides narrow waveguide widths in the plane of a plate construction, a waveguide architecture employing such a cavity launch design can yield a much denser waveguide pattern without manufacturing difficulty. Such a power distribution network is particularly useful in a phased array antenna system which tend to demand higher frequencies and accordingly denser waveguide architectures in their power distribution networks.

4. Method of Producing a Rectangular Waveguide Cavity Launch

Figure 8:
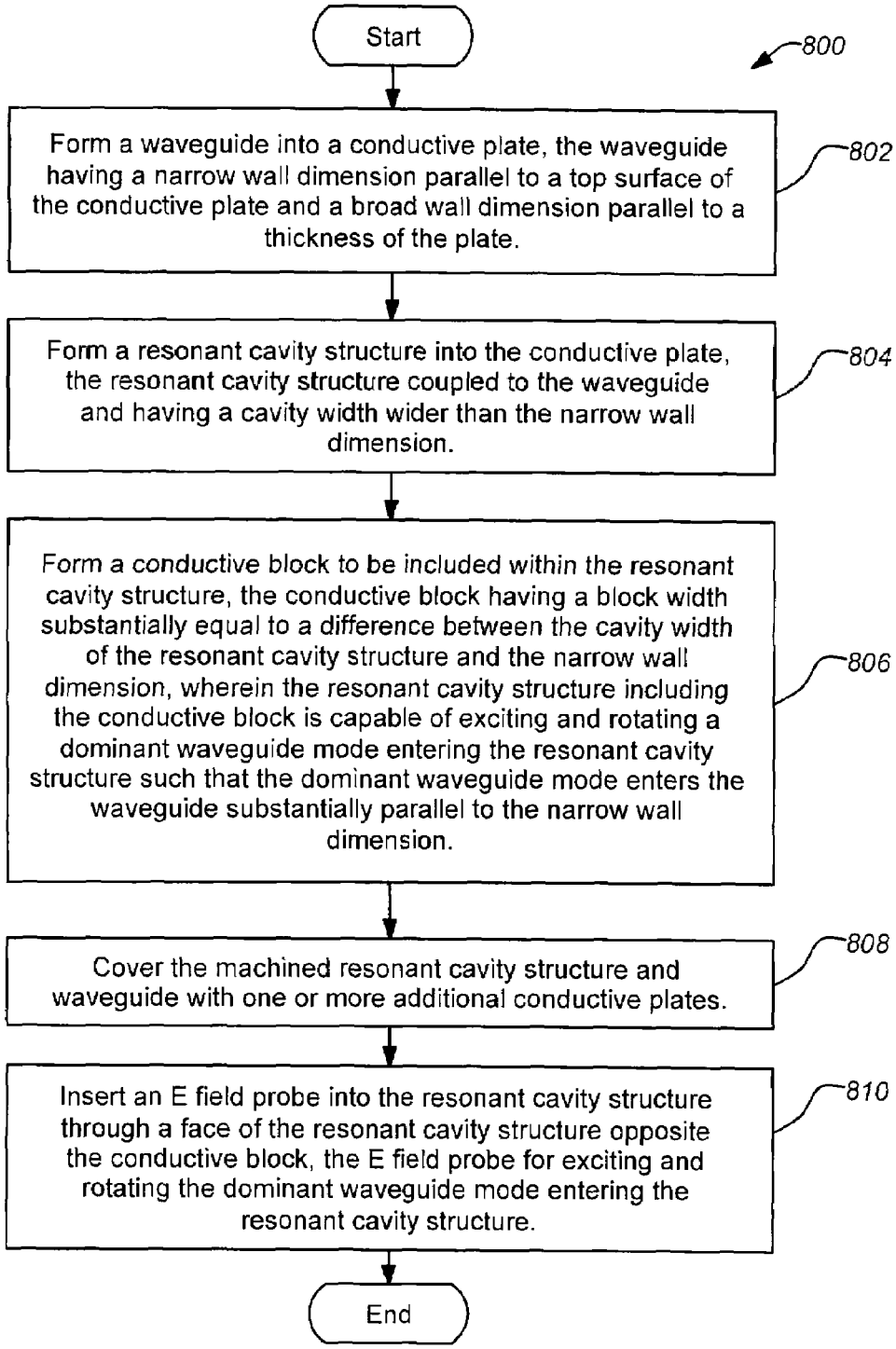
FIG. 8 is a flowchart of an exemplary method of producing a waveguide cavity launch embodiment of the invention.

FIG. 8 is a flowchart of an exemplary method 800 of producing a waveguide cavity launch embodiment of the invention. The method 800 starts with an operation 802 of forming a waveguide into a conductive plate, the waveguide having a narrow wall dimension parallel to a top surface of the conductive plate and a broad wall dimension parallel to a thickness of the plate. In operation 804, a resonant cavity structure is formed into the conductive plate, the resonant cavity structure coupled to the waveguide and having a cavity width wider than the narrow wall dimension. In operation 806, a conductive block is formed to be included within the resonant cavity structure, the conductive block having a block width substantially equal to a difference between the cavity width of the resonant cavity structure and the narrow wall dimension. As before, the resonant cavity structure including the conductive block is capable of exciting and rotating a dominant waveguide mode entering the resonant cavity structure such that the dominant waveguide mode enters the waveguide substantially parallel to the narrow wall dimension. Next, additional operations to complete the structure before the method 800 end may include an operation 808 of covering the machined resonant cavity structure and waveguide with one or more additional conductive plates and an operation 810 of inserting an E field probe into the resonant cavity structure through a face of the resonant cavity structure opposite the conductive block, the E field probe for exciting and rotating the dominant waveguide mode entering the resonant cavity structure.

It should be noted that the operations 802, 804 of forming the resonant cavity structure and the included conductive block (and even machining the waveguide) may be performed as essentially as a single operation. Alternately, separate processes may be performed to form the cavity launch and the waveguide structures, e.g. as described below. In addition, method embodiments of the invention may be further modified consistent with the apparatus and system embodiments previously described.

Embodiments of the invention may employ any suitable process for forming the resonant cavity structure, conductive block, and waveguide as necessary depending upon the conductive material of the plate being used in the particular waveguide design. Machining processes are typical, although other processes, e.g. casting, are also possible. Aluminum is the most common material, although copper and brass alloys are also a possibility. The waveguide itself may be manufactured using wire electrical discharge machining (EDM) which machines the network pattern through a metal plate. A top and bottom plate are then used to close the waveguide structure and form the two narrow walls. In this case, the conductive block must be separately machined as part of either the side of the initial plate, the bottom plate, or added as a separate element. Alternately, a sinker EDM process may be employed on the initial plate in the local region of the cavity launch to form the channels and bottom (including the conductive block) such that only a top plate is required in this region. Conventional wire EDM processing may employed for the remainder of the waveguide network using top and bottom plates to complete the waveguide network. Embodiments of the invention may be produced using a simple milling procedure (e.g. CNC machining), however the depth of the waveguide in the Z axis would likely require a large diameter mill which would leave a large radius in the corners. This is usually not an acceptable feature for a waveguide structure. However, the conductive block may be milled in with an end mill by such a process. Alternately, it is possible that the whole distribution network, including the cavity launch, may be cast if the production quantities warranted it. In any case, embodiments of the invention may be manufactured using any suitable techniques known to those skilled in the art for producing waveguide networks.

This concludes the description including the preferred embodiments of the present invention. The foregoing description been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. A waveguide cavity launch, comprising:

a waveguide formed into a conductive plate, the waveguide having a narrow wall dimension parallel to a top surface of the conductive plate and a broad wall dimension parallel to a thickness of the conductive plate;

a resonant cavity structure formed into the conductive plate and coupled to the waveguide, the resonant cavity structure having a cavity width wider than the narrow wall dimension; and a conductive block included within the resonant cavity structure, the conductive block having a block width substantially equal to a difference between the cavity width of the resonant cavity structure and the narrow wall dimension;

wherein the resonant cavity structure including the conductive block is capable of exciting and rotating a dominant waveguide mode entering the resonant cavity structure such that the dominant waveguide mode enters the waveguide substantially parallel to the narrow wall dimension.

2. The waveguide cavity launch of claim 1, wherein the broad wall dimension is substantially equal to a cavity height of the resonant cavity structure.

3. The waveguide cavity launch of claim 1, wherein the broad wall dimension is not equal to a cavity height of the resonant cavity structure.

4. The waveguide cavity launch of claim 1, wherein the waveguide, the resonant cavity structure and the conductive block are included in a power distribution network.

5. The waveguide cavity launch of claim 4, wherein the power distribution network is included in a phased array antenna system.

6. The waveguide cavity launch of claim 1, further comprising an E field probe inserted into the resonant cavity structure through a face of the resonant cavity structure opposite the conductive block, the E field probe for exciting and rotating the dominant waveguide mode along with the resonant cavity structure including the conductive block.

7. The waveguide cavity launch of claim 6, further comprising a conductive ridge disposed between the conductive block and a tip of the E field probe.

8. The waveguide cavity launch of claim 7, wherein the conductive ridge comprises a geometry for impedance matching the E field probe to the waveguide.

9. The waveguide cavity launch of claim 8, wherein the E field probe comprises a low impedance relative to a high impedance of the waveguide.

10. The waveguide cavity launch of claim 8, wherein the geometry of the conductive ridge comprises a ridge width less than the block width and a ridge length less than a block length of the conductive block.

11. A method of producing a waveguide cavity launch, comprising the steps of:

forming a waveguide into a conductive plate, the waveguide having a narrow wall dimension parallel to a top surface of the conductive plate and a broad wall dimension parallel to a thickness of the conductive plate;

forming a resonant cavity structure into the conductive plate, the resonant cavity structure coupled to the waveguide and having a cavity width wider than the narrow wall dimension; and forming a conductive block included within the resonant cavity structure, the conductive block having a block width substantially equal to a difference between the cavity width of the resonant cavity structure and the narrow wall dimension;

wherein the resonant cavity structure including the conductive block is capable of exciting and rotating a dominant waveguide mode entering the resonant cavity structure such that the dominant waveguide mode enters the waveguide substantially parallel to the narrow wall dimension.

12. The method of claim 11, wherein the broad wall dimension is substantially equal to a cavity height of the resonant cavity structure.

13. The method of claim 11, wherein the broad wall dimension is not equal to a cavity height of the resonant cavity structure.

14. The method of claim 11, wherein the waveguide, the resonant cavity structure and the conductive block are included in a power distribution network.

15. The method of claim 14, wherein the power distribution network is included in a phased array antenna system.

16. The method of claim 11, further comprising inserting an E field probe into the resonant cavity structure through a face of the resonant cavity structure opposite the conductive block, the E field probe for exciting and rotating the dominant waveguide mode along with the resonant cavity structure including the conductive block.

17. The method of claim 16, further comprising forming a conductive ridge disposed between the conductive block and a tip of the E field probe.

18. The method of claim 17, wherein the conductive ridge comprises a geometry for impedance matching the E field probe to the waveguide.

19. The method of claim 18, wherein the E field probe comprises a low impedance relative to a high impedance of the waveguide.

20. The method of claim 18, wherein the geometry of the conductive ridge comprises a ridge width less than the block width and a ridge length less than a block length of the conductive block.

21. A waveguide cavity launch, comprising:

a first means for transmitting a dominant waveguide mode, the first means having a narrow wall dimension parallel to a top surface of a conductive plate and a broad wall dimension parallel to a thickness of the conductive plate; and a second means for exciting and rotating a dominant waveguide mode entering the second means such that the dominant waveguide mode enters the first means substantially parallel to the narrow wall dimension, the second means being formed into the conductive plate and coupled to the first means and having a cavity width wider than the narrow wall dimension and including a conductive block within the second means, the conductive block having a block width substantially equal to a difference between the cavity width of the second means and the narrow wall dimension.

* * * * *